US005509184A

United States Patent [19]

Herrero

[11] Patent Number: 5,509,184

[45] Date of Patent: Apr. 23, 1996

[54] APPARATUS FOR CRIMPING A TUBE IN A THICK PANEL

[75] Inventor: Martial Herrero, Lillebonne, France

[73] Assignee: Trouvay & Cauvin S.A., Le Havre, France

[21] Appl. No.: 198,827

[22] Filed: Feb. 18, 1994

[30] Foreign Application Priority Data

Feb. 19, 1993 [FR] France ..... 93 01928

[51] Int. Cl.[6] ..... B21D 39/00

[52] U.S. Cl. ..... 29/252; 29/282; 29/283.5; 29/523; 29/522.1

[58] Field of Search ..... 29/243.517, 243.518, 29/282, 523, 522.1, 252, 512, 283.5, 255; 72/393, 353.6, 370

[56] References Cited

U.S. PATENT DOCUMENTS 4,654,943 4/1987 Rabe .

FOREIGN PATENT DOCUMENTS

0084940A1 8/1983 European Pat. Off. .

0309078A2 3/1989 European Pat. Off. .

*Primary Examiner*—Robert C. Watson

*Attorney, Agent, or Firm*—Baker & Daniels

[57] ABSTRACT a) An apparatus for crimping a tube in a thick panel, b) said apparatus being characterised in that the peripheral support (9) is a sleeve formed by adjacent fingers (91), separated by slots (93), the fingers being connected to a ring (92) which is not split and which is situated at the other end of the support (9), and the free end of the fingers (91) forms a cam surface intended to cooperate with the surface (82) of a cam (8).

2 Claims, 1 Drawing Sheet

APPARATUS FOR CRIMPING A TUBE IN A THICK PANEL

The present invention relates to an apparatus for crimping a tube in a thick panel comprising:

a source of hydraulic fluid under very high pressure, a mandrel adapted to be slid into the tube to be crimped at the position where the crimping is to be performed in the panel, this mandrel carrying two sealing-tight means defining, with the tube to be crimped, an annular expansion chamber to receive the pressurised fluid, each sealing means being composed of one or a plurality of deformable flexible seals, on the same side as the chamber, intended to close the chamber between the mandrel and the tube to be crimped, and a bearing device placed on the other side of the seals to support them while the chamber is being pressurised and to avoid the seals creeping when the interior cross-section of the tube to be crimped increases during the course of crimping, this bearing device being formed by an annular cam with a conical surface having a constant bearing surface on the side which is towards the seals, and a peripheral support having a conical surface corresponding to that of the cam, to be expanded by the annular cam and occupy the gap between the annular cam and the interior wall of the tube during crimping.

Such an apparatus is known from the Patent EP-83 300 163.1.

This hydraulic apparatus, intended for crimping tubes in thick panels, is composed of a cam forming the bearing surface for the deformable seals which close off the gap between the mandrel and the tube during expansion of this latter. This cam or conical cam surface co-operates with the front end of a segment of likewise conical surface and connected by a rubber gasket. Under the effect of the thrust exerted by the annular cam, the segments spread out and close the gap which remains between the outer edge of the bearing surface of the annular cam and the corresponding interior surface of the tube being crimped in order to support the deformable seal or seals in order to avoid it or them creeping into the gap which opens up more and more between the bearing surface of the cam and the interior surface of the tube.

It must be noted that this gap remaining between the bearing surface of the seals and the interior surface of the tube to be crimped may extend to more than 1 mm in the diametral direction.

This solution constitutes an improvement to the prior solution in which the support was provided solely by a sleeve split over its entire length. Indeed, in the case of the sleeve, no one could hope to obtain a regular support against creep on account of the slot into which the material of the seal bearing against this sleeve crept, the two-fold consequence of this creep being on the one hand to ruin the seal and on the other the locking of the sleeve this spread out, by maintaining its slot open and complicating removal of the mandrel after crimping.

The object of the solution described above was to remedy this drawback by providing an assembly consisting of a plurality of separate segments. However, this solution was not satisfactory in practice because on the one hand, for the assembly to have any grip, it was only possible to envisage having a very small number of segments and, on the other, at the moment of expansion, there is no guarantee of a regular expansion of the joints separating the segments; on the contrary, it frequently happens that the segments become compressed against one another to the extent that there is no longer more than just one single very large slot, resulting in the drawbacks of the prior art apparatus.

The object of the present invention is to remedy these drawbacks and proposes a crimping apparatus which makes it possible effectively to support the deformable seals bounding the pressure chamber in order effectively to support the seals, avoiding their creeping or—and this is a corollary thereof—in order to make it possible to work at very high pressures without risk.

For this purpose, the invention relates to an apparatus of the type defined hereinabove, characterised in that the peripheral support is a sleeve formed by adjacent fingers, separated by slots, the fingers being connected to a ring at the other end of the support and which is not split, the free ends of the fingers forming a cam surface intended to co-operate with the surface of the cam.

The crimping apparatus according to the invention makes it possible evenly to support the seal in the annular gap which is created during crimping between the outer edge of the bearing surface of the annular cam and the interior surface of the tube to be crimped, thanks to the fingers which, rigid with the ring which is not slotted, at the other end of the sleeve, can only expand evenly in such a way as to create regular gaps, avoiding the formation of a single gap of substantial size as in the prior art.

The seal is thus even supported over the entire gap and there is no possibility of its creeping under the effect of the very substantial crimping pressure of around 4000 bars. This avoids destruction of the seal or seals and facilitates removal of the apparatus after this crimping operation.

Furthermore, as the support consists of fingers and not separate segments, it is possible, without creating difficulties in terms of production, assembly or use,to have a relatively large number of fingers, to a degree which could never be envisaged with separate segments because the assembly would not have had sufficient grip.

According to the invention, the slots defining the fingers are preferably longitudinal slots parallel with the axis of the sleeve.

The present invention will be described in greater detail hereinafter with reference to an example of embodiment shown diagrammatically in the attached drawings in which.

Figure 1:
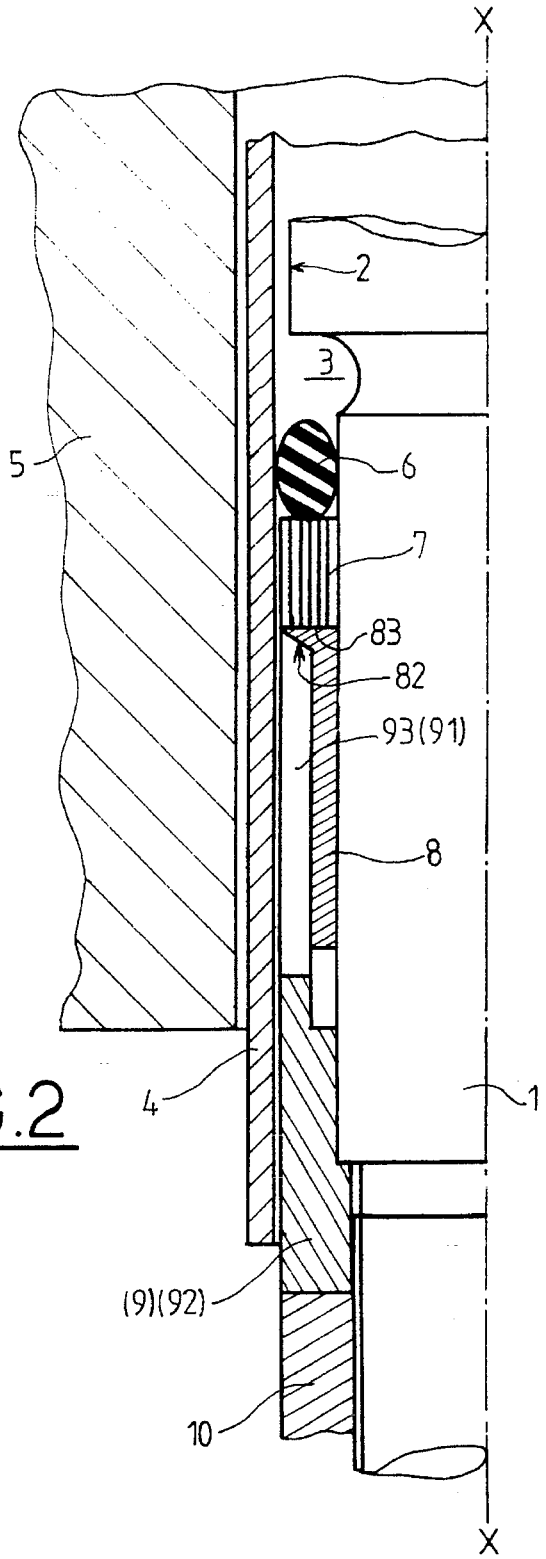
FIG. 1 is a partial axial half-section through a crimping apparatus according to the invention, placed in a tube end which is itself placed in the thick panel at the place where crimping is to be performed.

The apparatus, shown in FIG. 1 by half a cross-section, consists of a mandrel 1 of axis X—X. This mandrel is traversed by a bore, not shown, which opens out through the surface 2 of the mandrel into the annular expansion chamber 3 formed by the gap which is left between the mandrel and the interior wall of the tube 4 which it is desired to crimp into the thick panel 5. The apparatus according to the invention makes it possible to inflate the tube 4 at the location of the thick panel 5, locally deforming the tube in order to crimp it.

This mandrel 1 carries two identical or similar sealing means of which only one is shown in FIG. 1. This sealing means consists of a first seal 6 situated on the same side as the pressure chamber 3, and another seal 7 which supports the seal 6. The seals 6 and 7 are of a deformable elastic material to ensure sealing-tightness during expansion of the tube to be crimped; the seal 6 may be of rubber and the seal 7 of polyurethane.

These seals 6, 7 are supported (the second directly and the first indirectly) by a supporting device consisting of a cam 8 and a sleeve 9 which itself bears on an annular ring or screw 10 carried by the mandrel 1 on the outside of the tube 4 and serving to position and regulate the apparatus.

At the opposite end of the sealing-tight means thus described, in the upper part of the drawing, there would be a similar sealing means intended to bound the other side of the pressure chamber 3.

According to the invention, the supporting device composed of the cam 8 and of the peripheral support 9 will be described in greater detail with reference to FIG. 2 taken in conjunction with FIG. 1.

Figure 2:
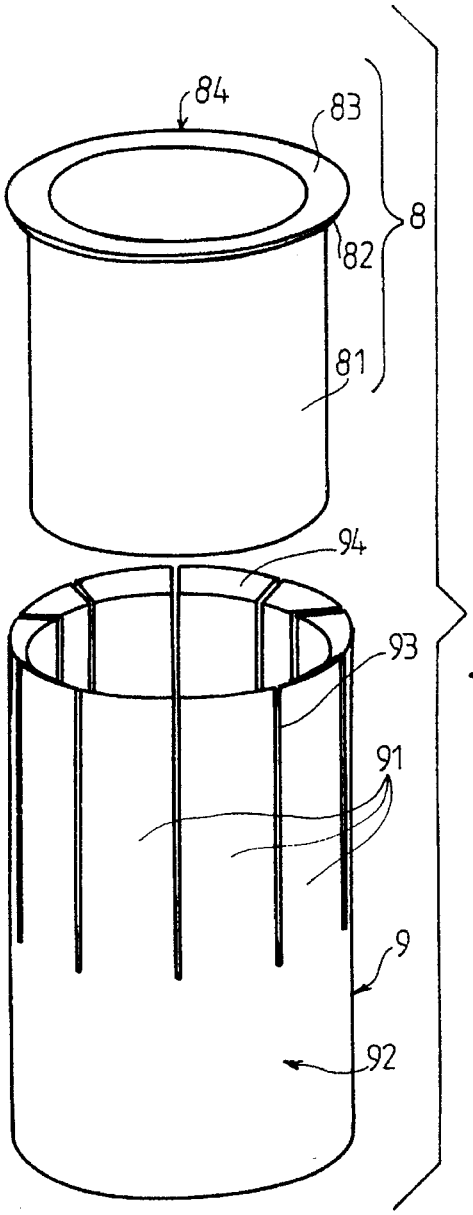
FIG. 2 is an exploded perspective view of the supporting device of the apparatus according to the invention.

According to FIG. 2, the cam 8 is in fact composed of a sleeve 81, a conical surface 82 and a bearing surface 83. This bearing surface 83 serves to support the seal 7. The conical surface 82 is intended to co-operate with the peripheral support 9 in order to open it.

This peripheral support 9 is constituted by a sleeve, one end of which carries fingers 91 connected to a ring 92 which is not split, at the other end of the support 9; these fingers 91 are defined by slots 93 which extend as far as the ring 92.

During crimping, the high pressure prevailing in the chamber 3 expands the tube 4 while pushing on the seals 6, 7. The pressure is transmitted by the surface 83 to the cam 8 which embeds itself in the peripheral support 9. Co-operation of the surface 82 and the surface 94 of the fingers 91 tends to move apart the fingers which will thus close off the gap remaining between the edge 84 of the cam 8 and the interior surface of the tube 4, preventing the seal 7 from creeping into this gap.

For assembly, the sleeve 81 of the cam 8 slides into the gap between the fingers 91 and, according to the length of the sleeve 81, so this latter arrives as far as the ring 92.

The front surface of the fingers 91 is bounded by a conical surface 94 the conicity of which corresponds to that of the conical surface 82 on the cam 88. Under the effect of a thrust exerted on the face 83, the cam 8 tends to embed itself in the peripheral support 9 and to move away from one another the fingers 91 which then close the gap created between the outer edge 84 of the bearing surface 83 and the interior surface of the tube 4 which is to be crimped.

I claim:

1. An apparatus for expanding a tube and securing said tube to a panel, said apparatus comprising:

an elongated mandrel adapted to be inserted into a tube;

said mandrel and tube defining an expansion chamber and adapted to receive a pressurized fluid;

a plurality of deformable annular seals arranged between said mandrel and tube for axially sealing one side of said expansion chamber, said plurality of seals axially arranged with respect to each other and to said mandrel;

a supporting means for supporting said seals while said expandable chamber is pressurized, said supporting means comprising an annular ring and an annular array of fingers having first ends and free ends, a plurality of slots for separating adjacent said fingers, said first ends connected to said annular ring, said free ends defining camming surfaces, said free ends radially outwardly moveable;

camming means operatively disposed with respect to said camming surfaces for moving said free ends of said fingers radially outwardly, whereby said tube is expanded by said free ends and is secured to said panel.

2. The apparatus according to claim 1 wherein said fingers are parallel with the axis of said annular ring.

* * * * *